United States Patent [19]

White

[11] 4,310,155

[45] Jan. 12, 1982

[54] SPRING TYPE LOWER LEG MUSCLE EXERCISER

[76] Inventor: William F. White, Partridge Hill, Williston, Vt. 05495

[21] Appl. No.: 50,137

[22] Filed: Jun. 20, 1979

[51] Int. Cl.[3] ..... A63B 21/04

[52] U.S. Cl. ..... 272/136; 272/142

[58] Field of Search ..... 272/136, 116, 140, 142, 272/135, 94, 96; 128/25 R, 25 B

[56] References Cited

U.S. PATENT DOCUMENTS

| | | | |
|---|---|---|---|
| 735,319 | 8/1903 | Urwick | 272/142 |
| 1,509,793 | 9/1924 | Thompson | 272/96 X |
| 2,542,074 | 2/1951 | Bierman . | |
| 2,645,482 | 7/1953 | Magida | 272/96 |
| 3,022,071 | 2/1962 | Malone et al. . | |
| 3,587,319 | 6/1971 | Andrews . | |
| 3,754,547 | 8/1973 | Walker | 272/135 X |
| 4,199,137 | 4/1980 | Giguére | 272/96 |

FOREIGN PATENT DOCUMENTS

| | | |
|---|---|---|
| 677882 | 3/1966 | Belgium . |
| 125351 | 1/1903 | Fed. Rep. of Germany . |
| 227 | of 1902 | United Kingdom . |
| 995971 | 6/1965 | United Kingdom . |

*Primary Examiner*—Richard C. Pinkham
*Assistant Examiner*—William R. Browne
*Attorney, Agent, or Firm*—Price, Heneveld, Huizenga & Cooper

[57] ABSTRACT

An apparatus for developing the lower leg muscles used while skiing includes a base and a foot holder. A joint interconnects the foot holder with the base and permits multi-axis, compound motion of the holder. A flexible force applying member engages the foot holder substantially at the terminal free end of the foot holder opposite the heel receiving portion to bias the holder to the initial position which is generally vertical with respect to the base and to oppose movement of the holder from an initial position.

12 Claims, 4 Drawing Figures

SPRING TYPE LOWER LEG MUSCLE EXERCISER

BACKGROUND OF THE INVENTION

The present invention relates to sports training devices and, more particularly, to a device for exercising, strengthening and developing the lower leg muscles.

Heretofore, a fairly wide variety of specialized exercising equipment have been proposed for exercising particular muscle groups used in a particular sport. Such equipment, for example, has been developed for sports such as golf, baseball and football. Development of specific muscles or muscle groups is particularly helpful in increasing proficiency and avoiding injury.

Skiing, in particular, is a sport which requires development of specific muscle groups to increase proficiency and prevent injury. Downhill and cross-country skiing are sports which continue to grow in popularity. Downhill or Alpine skiers are exposed to and suffer sprains and breaks of the ankle, breaks of the lower leg bones, that is the fibula and tibia, and torn ligaments or cartilage at the knee and ankle joints. These types of injuries typically occur when the mechanical safety bindings holding the boot to the ski fail to operate properly. These bindings typically include a lateral or side-to-side toe release and vertical heel release. The settings are variable to accommodate the weight of the skier as well as the proficiency level of the skier. The bindings may be improperly adjusted or may operate improperly due to dirt and/or ice which can collect thereon and increase the load on the leg prior to release.

It is, therefore, important for the skier to develop strong muscles of the lower leg to reduce the chance of and occurrence of injury. Further, the muscles of the lower leg are primarily used to initiate turns for both the recreational and competition skier. A competition skier, especially when competing in the slalom, may execute frequent step turns which require rotation of the ski about a vertical axis. The lower leg muscles are primarily used to accomplish such rotation. The muscles used to accomplish these turns are the same which are used to resist the forces involved in a lateral ski boot/binding release.

Heretofore, exercising equipment has not been developed to strengthen the lower leg muscles and, therefore, to assist in preventing injury to skiers and to increase proficiency. Presently available exercising devices are primarily directed for use by invalids or for physical therapy. Examples of such devices may be found in U.S. Pat. No. 2,645,482, entitled FOOT ACTUATED EXERCISING DEVICE, and issued on July 14, 1953 to Magida, and U.S. Pat. No. 3,022,071, entitled FOOT ACTUATED EXERCISING DEVICE and issued on Feb. 20, 1962 to Malone, et al. These devices are not capable of subjecting the lower leg muscles to the stresses or the loads necessary to properly develop them and strengthen them for skiing.

A need, therefore, exists for an exercising apparatus capable of developing and strengthening the lower leg muscles by subjecting them to the same stresses and loads encountered while skiing. Such a device would greatly assist in the prevention of injury to skiers as well as increase their proficiency by increasing quickness and ski control.

SUMMARY OF THE INVENTION

In accordance with the present invention, a lower leg muscle exercising apparatus is provided which accommodates the needs of the recreational and competition skier, and whereby the shortcomings of presently available leg exercising devices are substantially overcome. Essentially, the device includes a foot retaining means and a base. Provision is made for supporting the foot retaining means on the base for multi-axis movement to thereby accommodate flextion and extension of the ankle as well as rotation of the lower leg. Provision is made for applying a force opposing movement of the foot retaining means and which constantly biases the foot retaining means to an initial position.

In narrower aspects of the invention, the force exerted on the foot retaining means in resisting movement thereof increases with motion of the foot retaining means. The apparatus permits both dynamic and isometric exercising of the lower leg muscles and simulates the loads imposed in resisting boot/binding release and during normal skiing motions.

DETAILED DESCRIPTION OF THE PREFERRED EMBODIMENT

Figure 1:
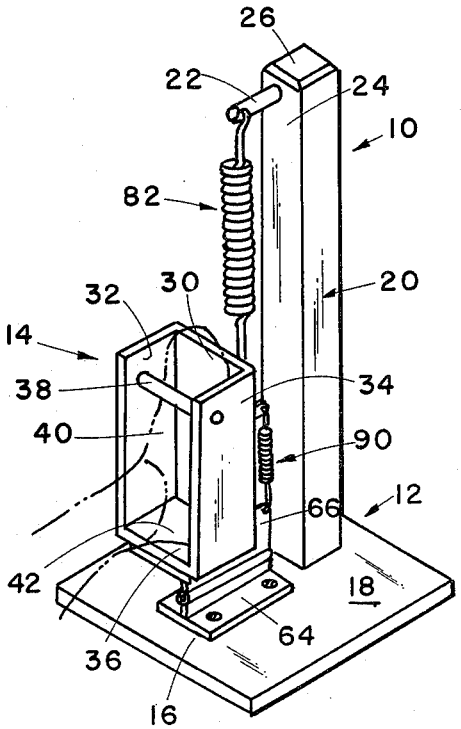
FIG. 1 is a perspective view of a lower leg muscle developing apparatus in accordance with the present invention.

A preferred embodiment of the apparatus in accordance with the present invention is illustrated in FIG. 1 and generally designated 10. Apparatus 10 includes a generally rectangular, horizontally positioned base 12 and a foot retaining means or foot holder 14 supported on base 12 by a joint structure 16 in a normally vertical orientaton with respect to the base. Extending generally vertically from or perpendicular to an upper surface 18 of base 12 is a post 20. A bracket or spring attachment rod 22 extends outwardly from a face 24 of post 20 adjacent the top end 26 thereof.

Foot retaining or holding means 14 is a generally box-like structure including a bottom wall 30, opposed, parallel, spaced sides 32, 34, and an end wall or heel abutting portion 36. Holder 14 is open at the end opposite end wall 36. Extending between sidewalls 32, 34, adjacent the open end of the holder is a toe retainer or restrainer rod or bar 38. As illustrated in FIG. 1, holder 14 is dimensioned to receive the foot 40 of the user. The heel 42 of the user will abut wall 36 and the foot is retained by contact with bar 38. The holder is constructed to permit movement thereof by flexion, extension and rotation of the ankle and lower leg about multiple axes.

Figure 2:
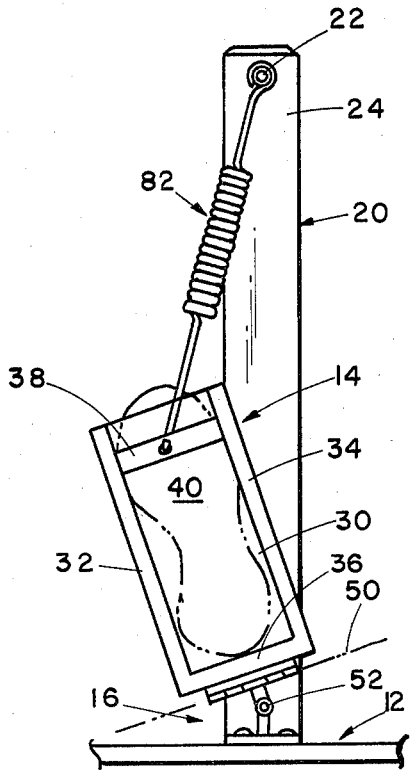
FIG. 2 is a front, elevational view thereof.
Figure 3:
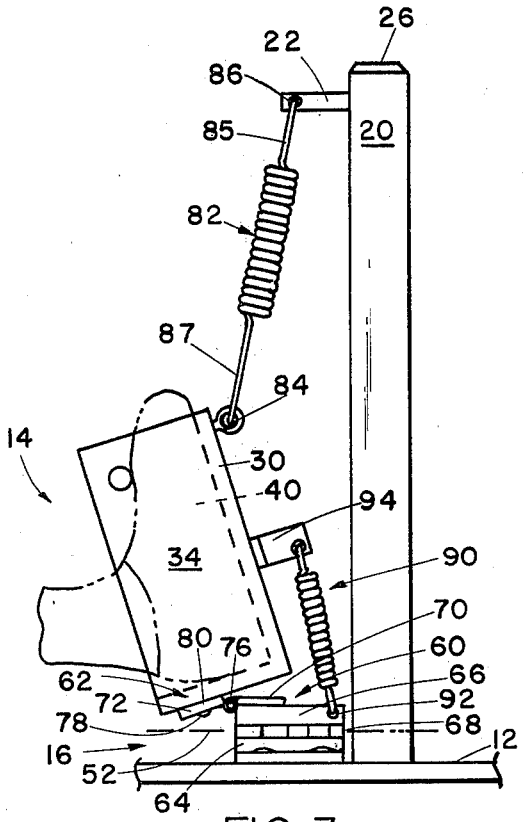
FIG. 3 is a right, elevational view thereof.

Joint means 16 supports the holder 14 on base 18 for movement about a vertical or pitch axis, generally designated 50 in FIG. 2, and about a lateral or yaw axis, generally designated 52 in FIG. 3. The joint permits simultaneous movement about both axes to permit compound rotational movement of the holder.

In the embodiment illustrated in FIGS. 1, 2 and 3, joint 16 includes a first hinge 60 and a second hinge 62. Hinge 60 includes a first hinge plate 64 secured to base 12, a second hinge plate 66 and a hinge pin 68 which defines the pivot axis 52. Hinge 62 similarly includes a first hinge plate 70 which is welded or otherwise suitably secured to hinge plate 66 of hinge 60. Hinge 62 further includes a second hinge plate 72 connected to plate 70 by a pivot or hinge pin 76. Plate 72 is secured by suitable fasteners 78 to outer surface 80 of bottom wall 36.

A yaw or lateral spring 82 extends between rod 22 and an attachment in the form of an eye bolt 84 secured to wall 30 of holder 14 adjacent the top thereof. Spring 82 is preferably a coil spring having one end 85 extending through an aperture 86 formed in post bracket 22. The opposite end 87 of the spring extends through the eye of attachment 84. Spring 82 provides a restoring force which increases upon lateral or yawing movement of the holder, as seen in FIG. 2, for example. The force exerted on a holder by the spring resists movement serving to exercise and develop the lower leg muscles. Another spring 90 extends between an aperture 92 formed in the second plate 66 of hinge 60 and a bracket 94 secured to wall 30. This is best seen in FIG. 3. Spring 90 provides an increasing force or resistance to movement of the foot holder 14 in a vertical plane about pitch axis 50. Spring 90 also is preferably a coil spring.

The resistance to movement exerted on the box by the springs 82, 90 exercises the lower leg muscle as the foot is moved about the multi-axis joint 16. The force which the foot must oppose is easily and readily changed merely by substitution of springs having greater or lower spring rates. The springs 82, 90 bias the foot holder 14 to an initial or at rest position, which is illustrated in FIG. 1. The restoring force increases in a generally linear fashion as a function of distance of movement of the holder 14 from the initial position.

In use, the apparatus 10 will be placed on the floor or any suitable level surface. The box or foot holder 14 is held in a generally vertical or perpendicular orientation by the springs 82, 90 and by the hinge means or joint 16. The user assumes a seated position in front of the holder 14 and inserts his foot into the holder as shown in FIG. 1. The lower leg muscles are exercised and developed by flexion and extension of the foot and by rotation of the lower leg. Compound motion is obtained by the multi-axis joint 16. Movement of the holder 14 by the user creates a dynamic load on the ankle and leg muscles. The holder can be rotated as far as possible by the user and then held in the rotated position for a suitable period of time, five to ten seconds, for example. When holding the box, a static load is placed on the muscles and the benefits of isometric exercise are obtained.

The apparatus, by permitting lateral or side-to-side movement of the foot and vertical movement about the pitch axis, simulates the forces exerted on the leg during ski boot/binding release or when the ski is rotated during turning. Lateral movement and vertical movement can be performed independently or done together in a compound motion. Some ski bindings permit simultaneous toe and heel release. Also, some bindings allow side-to-side motion of both the toe and heel. The present invention is capable of simulating the loads of all of these bindings.

Figure 4:
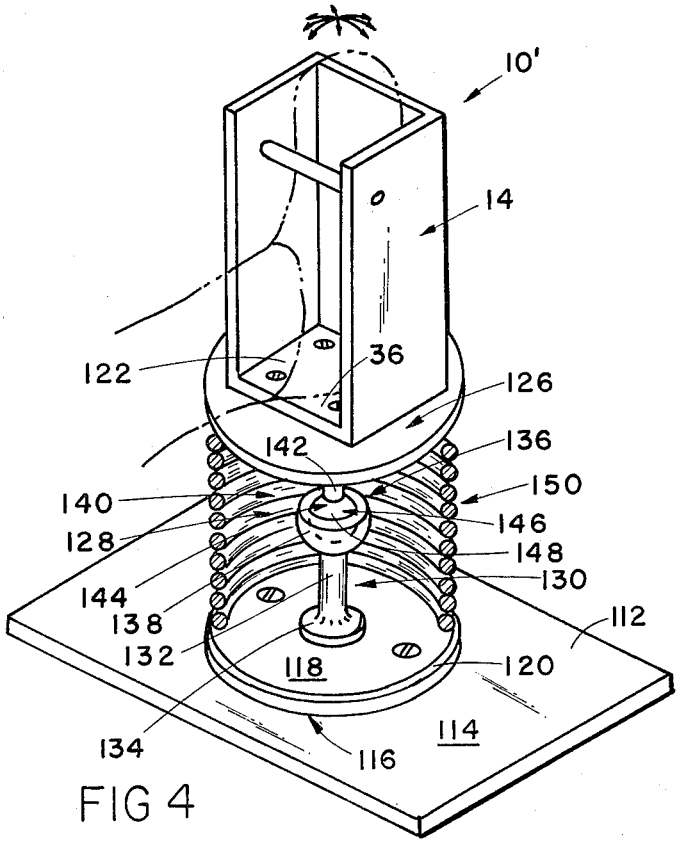
FIG. 4 is a perspective view of an alternative embodiment of the present invention.

An alternative embodiment of an apparatus in accordance with the present invention is illustrated in FIG. 4 and generally designated 10'. Embodiment 10' similarly includes a base 112 having an upper surface 114. Secured to the base 112 is a lower, generally cylindrical, cup-shaped spring retainer 116. Spring retainer 116 includes a base or bottom wall 118 and a peripheral skirt 120. Supported above retainer 116 is the foot holder or foot retaining means 14. In embodiment 10', foot retaining means 14 is secured by suitable fasteners 122 extending through end wall 36 and to an upper spring retainer 126. Upper spring retainer is superimposed on lower spring retainer 116. Positioned between the spring retainers and supporting foot holer 14 is a joint structure 128. Joint structure 128 includes a rod-like lower member 130 having an elongated, generally cylindrical rod-like portion 132 which is secured at a lower end 134 to the lower spring retainer 116 and hence the base 112. An upper end 136 of member 130 defines a concave, socket-like member 138. Joint 128 further includes another rod-like member 140 having an elongated portion 142 secured at its upper end to the upper spring retainer 126. A lower end 144 of member 140 defines a ball element 146 having a spherical bearing surface 148. Ball element 146 is snapped within socket portion 136 and held thereby. Joint 128 permits multi-axis movement of foot holder 14 in a semihemispherical plane. Resistance to movement is accomplished by a coil spring 150, schematically shown in FIG. 4. Coil spring 150 is preferably in compression and is held between upper retainer 126 and lower retainer 116 by joint 128. Spring 150 is dimensioned so as to be held in place by the peripheral skirt 120 of retainer 116 and peripheral skirt 120 of upper retainer 126. The longitudinal axis of member 130 is coincident with the longitudinal axis of spring 150.

The operation of the embodiment illustrated in FIG. 4 is essentially the same as that of the FIG. 1 embodiment. The user places his or her foot within the foot holder 14 which is secured to the upper retainer 126. The foot may now be moved in almost any direction with the heel pivoting or rotating approximately about the ball and socket joint 128. The foot may be moved in a lateral or side-to-side motion in a vertical plane or in any one of a number of circular motions. Resistance, dynamic and static loading of the leg muscles are accomplished by the compression spring 150.

A device in accordance with either of the preferred embodiments of the present invention allows the lower leg muscles to be stressed, exercised and developed in the same manner that they are stressed during a ski boot/binding release or attempted release. The muscles are exercised as they would during during normal skiing. The invention permits development to achieve increased proficiency and quick and controlled foot-ski rotation.

Although developed primarily to assist a skier in increasing lower leg strength, the device in accordance with the present invention could be used by any athlete involved in an activity requiring lower leg strength. The present invention, therefore, provides for the exercise and strengthening of the lower leg in both dynamic and static modes and is useful in preventing injury and increasing proficiency in a variety of athletic endeavors.

In view of the foregoing description, those of ordinary skill in the art will undoubtedly envision various modifications which would not depart from the inventive concepts disclosed herein. For example, instead of a single compression, coil spring 150 in the FIG. 4 embodiment, a plurality of smaller diameter springs could be arranged in a circular array and compressed between the upper and lower spring retainers. Further, it is believed that a joint other than the ball and socket joint or the double hinge joint structure illustrated could be used. The primary consideration is that multi-axis or compound movement of the foot holder be provided. Therefore, it is expressly intended that the above description should be considered as that of the preferred embodiment. The true spirit and scope of the present invention may be determined by reference to the appended claims.

The embodiments of the invention in which an exclusive property or privilege is claimed are defined as follows:

1. A lower leg muscle exercising apparatus adapted to strengthen the muscles used while skiing, said apparatus comprising:

a generally horizontal base;

a foot holder, having a heel receiving portion, said foot hold being initially oriented in substantially a perpendicular position relative to the base;

joint means interconnecting the heel receiving portion of the foot holder to the base for defining two different axes for permitting compound motion of the foot holder relative to the base about said axes; and flexible force applying means engaging the foot holder substantially at the terminal free end of the holder opposite the heel receiving portion to bias the holder to the initial position which is generally vertical with respect to said base and to oppose movement of the foot holder from the initial position in any direction about said axes whereby a user may pivot, rotate and hold his foot about said axes against the resistance of the force applying means to thereby strengthen the lower leg muscles.

2. A lower leg muscle exercising apparatus as defined by claim 1 wherein said force applying means comprises a spring having one end retained on the base and another end retained on the foot holder, said foot holder including a bottom wall, spaced opposed sidewalls, an end wall and a toe bar extending between said sidewalls in spaced relationship to said end wall.

3. A lower leg muscle exercising apparatus as defined by claim 2 wherein said joint means comprises:

a first hinge having a plate secured to the base, said first hinge defining a yaw axis; and a second hinge connected to said first hinge and connected to said foot holder, said second hinge defining a pitch axis which is perpendicular to said yaw axis.

4. A lower leg muscle exercising apparatus as defined by claim 3 further including a post extending from said base in spaced relationship with said joint means, said spring being connected to said base by having said one end connected to said post, said spring thereby resisting movement of the foot holder about the yaw axis.

5. A lower leg muscle exercising apparatus as defined by claim 4 wherein said force applying means further includes another spring having an end secured to the joint means and another end secured to said foot holder, said another spring resisting movement of the foot holder about the pitch axis.

6. A lower leg muscle exercising apparatus as defined by claim 5 wherein said springs are coil springs.

7. A lower leg muscle developing device permitting flexion and extension of the ankle of the user and rotation of the lower leg, said device comprising:

a base;

a foot retaining means, having a heel receiving portion, said foot retaining means being oriented substantially perpendicular to the base for retaining the foot of the user; and joint means on the base for interconnecting the heel receiving portion of the foot retaining means to the base and for mounting the foot retaining means to permit multi-axis movement relative to said base and permit the user to apply a force to the retaining means which is acted upon by a force opposing movement of the foot retaining means, said joint means on the base comprising:

a post extending perpendicular to said base; and a flexible spring means which includes a spring that applies the resistance to movement of the retaining means and biases said retaining means to substantially an upright position, said flexible spring means being connected at one end to the upper free end of the post and to a toe receiving portion of the foot retaining means by the other end thereof.

8. A device as defined by claim 7 wherein said joint means on the base further includes:

another spring having an end secured to said hinge means and another end secured to said foot retaining means.

9. A device as defined by claim 8 wherein said joint means comprises:

a first hinge having a first plate pivotally connected to a second plate by a hinge pin, said first plate being fixed to said base; and a second hinge having a first hinge plate secured to the second plate of said first hinge and a second hinge plate pivotally connected to said first hinge plate by a hinge pin positioned perpendicular to said hinge pin of said first hinge, said second hinge plate of said second hinge being secured to said foot retaining means.

10. A device as defined by claim 9 wherein said an end of said another spring is connected to said second plate of said first hinge.

11. A device as defined by claim 10 wherein said foot retaining means comprises:

a box-like structure having a bottom wall, spaced opposed side walls and an end wall, said holer further including a toe bar extending between said side walls.

12. A device as defined by claim 11 wherein said springs are coil springs.

* * * * *

UNITED STATES PATENT AND TRADEMARK OFFICE

CERTIFICATE OF CORRECTION

PATENT NO. : 4,310,155

DATED : January 12, 1982

INVENTOR(S) : William F. White

It is certified that error appears in the above—identified patent and that said Letters Patent is hereby corrected as shown below:

Column 1, line 53, delete "ACTUATED".
Column 2, line 7, "flextion" should be --flexion--.
Column 5, line 12, "hold" should be --holder--.
Column 6, line 50, "holer" should be --holder--.

Signed and Sealed this

*Fifteenth* Day of *June 1982*

[SEAL]

*Attest:*

GERALD J. MOSSINGHOFF

*Attesting Officer* *Commissioner of Patents and Trademarks*